US009554437B2

(12) United States Patent
Altamura et al.

(10) Patent No.: US 9,554,437 B2
(45) Date of Patent: Jan. 24, 2017

(54) DECORATIVE LIGHT STRING SWITCHABLE BETWEEN DIFFERENT ILLUMINATION STATES

(71) Applicant: Seasonal Specialties, LLC, Eden Prairie, MN (US)

(72) Inventors: Steven Altamura, Scarsdale, NY (US); Christine Werner, St. Louis Park, MN (US); Weng Yunbing, Taizhou (CN); Chen YongTai, WenLin (CN)

(73) Assignee: Seasonal Specialties LLC, Eden Prairie, MN (US)

( * ) Notice: Subject to any disclaimer, the term of this patent is extended or adjusted under 35 U.S.C. 154(b) by 0 days.

(21) Appl. No.: 14/879,351

(22) Filed: Oct. 9, 2015

(65) Prior Publication Data

US 2016/0105937 A1 Apr. 14, 2016

Related U.S. Application Data

(60) Provisional application No. 62/061,836, filed on Oct. 9, 2014.

(51) Int. Cl.

| | |
|---|---|
| ***H05B 39/09*** | (2006.01) |
| ***H05B 41/36*** | (2006.01) |
| ***F21S 10/00*** | (2006.01) |
| ***F21S 10/02*** | (2006.01) |
| ***H05B 33/08*** | (2006.01) |

(52) U.S. Cl.
CPC ..... *H05B 33/0842* (2013.01)

(58) Field of Classification Search
None
See application file for complete search history.

(56) References Cited

U.S. PATENT DOCUMENTS 5,749,646 A * 5/1998 Brittell ..... F21S 10/02 362/231
5,871,271 A * 2/1999 Chien ..... A42B 3/044 362/103

* cited by examiner

*Primary Examiner* — Douglas W Owens
*Assistant Examiner* — Dedei K Hammond
(74) *Attorney, Agent, or Firm* — Altera Law Group, LLC

(57) ABSTRACT

A system and method of creating a steady ON and a special effects light effect from a bulb without providing any special wiring thereto. In one embodiment, the bulb contains an illumination element and a controller which produces the special effect in the element. By interrupting the flow of current to the controller periodically, the controller is initialized to its initial steady ON condition. A plurality of steady ON pulses at a high frequency will appear as a steady ON light, instead of pules, thereby producing a steady ON appearance without special wiring. When the current is allowed to flow continuously, the controller produces the special effect. A second embodiment uses parallel polarized light element which produce different effect when power is applied in opposite polarities, thereby providing two effects with no special wiring.

11 Claims, 7 Drawing Sheets

| 1 | 2 | CONDITION |
|---|---|---|
| + | − | ALL STEADY ON |
| − | + | SOME OR ALL TWINKLE |

DECORATIVE LIGHT STRING SWITCHABLE BETWEEN DIFFERENT ILLUMINATION STATES

INCORPORATION BY REFERENCE

This application incorporates by reference in its entirety provisional application Ser. No. 62/061,836 filed 9 Oct. 2014 entitled Convertible Twinkle Light String Switchable To Steady-On Light String for which it also claims priority.

TECHNICAL FIELD

This disclosure relates to decorative lighting strings of lights having a plurality of bulbs spaced along the string.

BACKGROUND

Decorative lighting, such as holiday lighting includes strings of bulbs spaced out along a pair of wires. The bulbs may be incandescent or now more frequently, LEDs. Light strings can be made much more interesting if they can switch illumination state, color, or other special effects. Twinkling is particularly attractive. Twinkling or flashing as the bulbs change from on to off, at different frequencies or different illumination slopes to give the visual impression that the bulbs are shimmering.

To create these special effects, the bulbs can be directly wired to a power source which controls the current flow in such a way as to pulse/twinkle or create other special lighting effects. To control bulbs in such a manner, would either require multiple conductors to each bulb for individual control or multiple conductors creating different circuits to alternatingly spaced bulbs to create simulate random sequencing of changing color, shimmering, or flashing.

Alternatively, the bulbs may contain their own microcontroller built into each or some of the bulbs or lamp holders, such that normal wiring can be used, however, the disadvantage to this construction is that the user is not able to select the mode of those lights, such as all being steady illuminating in one mode, and another mode where they perform their intended function of the microcontroller electrically connected to those individual bulbs.

In an alternative construction, bulbs may include addressable circuits which allow digital control signals to be sent to all bulbs in a wired string, and the signal intended by a particular bulb can be decoded by IP or other addressing, to control only that bulb. Such an addressable solution is expensive because it requires advanced logic be provided at the power source and each bulb must have a decoder.

Therefore, to obtain the benefits of control of function and illumination method of bulbs without additional wiring, sophisticated, or expensive circuits has not been possible.

It has been shown in the market that people would like the option to have single light set that can offer both a steady on lighting effect and other lighting effects, such as a twinkling effect that can be user selected, so that depending on the mood of the user, or event, the lights can either be set to be steady on or twinkle, color changing, or other switchable effects.

Twinkling can be described as a change in brightness (ramping up/down, dimming) or a switching on/off and changing the frequency of the switching or both including the separate control of red, green and blue LEDs in a single lamp structure to create color changing effects that include fading or flashing.

SUMMARY

The following summary is intended to assist the reader in understanding the full disclosure and the claims. The claims define the scope of the invention, not this summary.

There is disclosed a system for switchably changing the function of a special function bulb controller to switch an illumination element between having visual appearance of steady-on and a visual appearance of a predetermined special visual function, having a. an electrically powered illumination element;

b. a first switching circuit in communication said illumination element for controlling the flow of current to the element, said first circuit containing a controller for controlling the power to said illumination element to produce a predetermined special illumination visual lighting effect in the illumination element, said first circuit initiating said lighting effect when powered up starting from an initial steady on illuminated state in the element and then proceeding to other special lighting effects occurring after the steady on power up and periodically repeating said special lighting effect for a predetermined period of time; and c. a second switching circuit in communication with said first circuit, configured to periodically interrupt the flow of current to said first circuit, at an interruption frequency sufficient to cause the second circuit to reset to its steady on state without proceeding to said other special lighting effects, and thereby producing a plurality of steady on illumination pulses in the illumination element.

Also disclosed is wherein said interruption frequency is at least sufficient to create the visual appearance in the illumination element of a steady on light.

Also disclosed is wherein said interruption frequency is at least sufficient to provide a plurality of light pulses from the illumination element which appear of substantially uniform intensity.

Also disclosed is wherein said interruption frequency is at least beyond the frequency of a human to observe flicker in the illumination element.

Also disclosed is wherein said interruption frequency includes periodically energizing and reenergizing the second circuit to at least sufficiently create the visual appearance in the illumination element of a steady on illumination.

Also disclosed is wherein said special function is a twinkle light effect.

Also disclosed is wherein said special function is a blinking light effect.

Also disclosed is wherein said special function is a color changing effect.

Also disclosed is wherein said special function is a color hue changing effect.

Also disclosed is wherein steady on includes a momentary illumination at a substantially uniform light output.

Also disclosed is a system for switchably converting a special effect lighting system to switch from a steady on light output to a special effect light output having a. a light string including:

1. a first illumination element which illuminates when energized when powered in a first polarity and not a second opposite polarity;
2. a second illumination element connected in parallel with said first element and configured to output light with a special lighting effect when power is applied in the second polarity only;

b. a switching circuit connected to said elements, said circuit applying power to said string in said first polarity so only said first element will illuminate, and, then apply power in said second polarity, thereby illuminating only said second illumination element with said special effect.

Also disclosed is wherein said first element illuminates when power is applied in either polarity.

Also disclosed is wherein said first and second elements illuminate alternately when Alternating Current (AC) power is applied thereto.

Also disclosed is wherein the circuit is a reversing switch.

Also disclosed is wherein said special effect is light twinkling.

Also disclosed is wherein said special effect is color changing.

Also disclosed is wherein said special effect is color hue changing.

Also disclosed is a method of switchably changing the function of a special function bulb controller to switch an illumination element between having visual appearance of steady-on and a visual appearance of a predetermined special visual function, having any or all of the steps of in any order:

a. electrically powering illumination element;

b. in communication said illumination element, controlling the flow of current to the element to produce a predetermined special illumination visual lighting effect in the illumination element, controlling said element so that when it is powered up starting with an initial steady on illuminated state in the element and then proceed to said special lighting effects occurring after the steady on power up and periodically repeating said special lighting effect for a predetermined period of time, and c. periodically interrupt the flow of current to said first circuit, at an interruption frequency sufficient to cause a steady on state without proceeding to said special lighting effects, and thereby producing a plurality of steady on illumination pulses in the illumination element.

DETAILED DESCRIPTION

Embodiment 1

Figure 1:
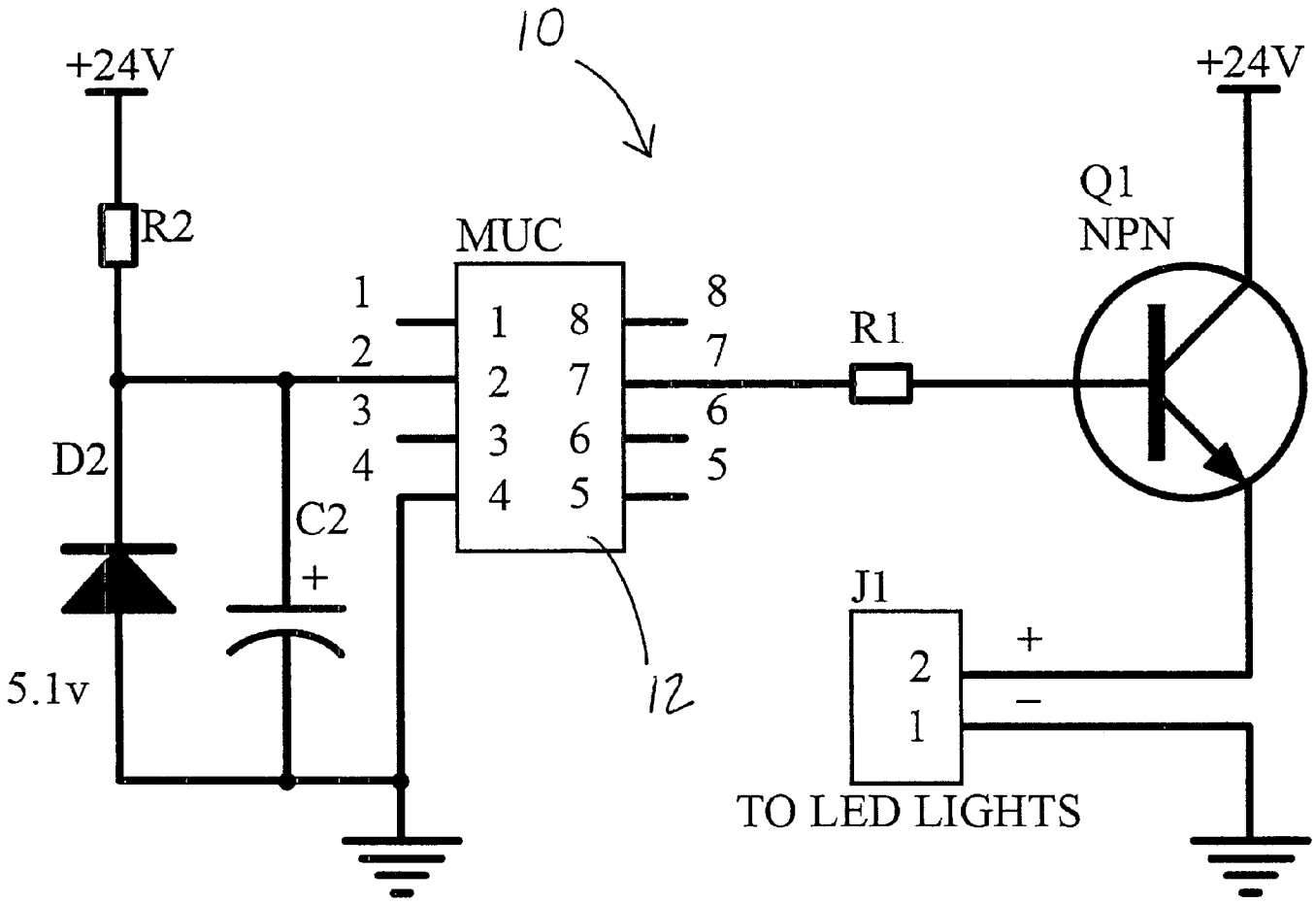
FIG. 1 illustrates an exemplary circuit 10 for which can be connected to light string (not shown) at connector J1.

In this embodiment, a light string can be controlled to operate specially configured bulbs to switch from one state to another without the need to reverse polarity of the power supply, adding additional control wires, or use of addressable bulbs and a controller. A "bulb" in this instance is an illumination element, such as an LED, incandescent lamp or equivalent which produces light in response to electrical current. It may also include a circuit or chip which controls the function of the illumination element. The two may be combined into a single unit or physically separated. The chip may be integral to the illumination element, in a socket for the element or entirely separated though electrically connected.

The "state" switching can be from on to off, or special effects versions thereof, such as twinkling, pulsing, flashing or other brightness varying effects, color changing, hue changing or other optical effects as determined by the type of control circuits and bulb types provided.

It is possible to include mixture of state controllable/switching bulbs with standard non switching bulbs since the visual effect can be achieved with less than all bulbs being controlled.

More generally, there is disclosed a system for switchably changing the function of a special function bulb controller to switch an illumination element between having visual appearance of steady-on and a visual appearance of a predetermined special visual function, having an electrically powered illumination element and a first switching circuit in communication said illumination element for controlling the flow of current to the element. The first circuit containing a controller for controlling the power to said illumination element to produce a predetermined special illumination visual lighting effect in the illumination element. The first circuit preferably is configured to power up starting from an initial steady on illuminated state, even for a brief period of time at a relatively uniform level of illumination. Then the rest of the special lighting effects are generated by the controller after the steady on power up the special effects are periodically repeated.

There is preferably a second switching circuit in communication with said first circuit, configured to periodically interrupt the flow of current to said first circuit, at an interruption frequency (i.e. on/off switching rate) sufficient to cause the second circuit to reset to its steady on state without or generally before the controller proceeds to the other special lighting effects. By using a switching (on/off) frequency at least higher than what the human eye can perceive as a pulse, the switching will produce a plurality of steady on illumination pulses in the illumination element, but the user will see a substantially steady light. When the second circuit provides a steady current, the illumination elements will produce their special effects, such as twinkling, according the predetermined configuration of the controller.

Thus, no special wires are required to provide these two controller states other than two power conductors to the bulbs.

The interruption frequency is at least sufficient to provide a plurality of light pulses from the illumination element which appear of substantially uniform intensity. The steady on period can also be a period where the intensity is gradually diminishing, but in a train of pulses, it will be seen by a human viewer as steady on.

The preferred interruption frequency is at least beyond the frequency of a human to observe flicker in the illumination element.

In this embodiment, the state switchable bulbs include a circuit which controls the current to the illumination element (usually an LED) to cause the desired effect. Such a circuit includes a timing device which repeats the special effect on a cyclical basis, the effect being triggered by the timer. If the current is continuously applied to that bulb, the circuit will continuously produce the special effect (such as twinkling and/or color changing) by cycling through preprogrammed steps of changing the current supplied to the illumination element. By interfering with the cycle, it is possible to have such a circuit act as if it was not producing the special effect, but rather, attempting to initialize the effect, by repeatedly being restarted. This is accomplished by sending a reset signal to the circuit, making it think that it must restarted from its beginning state (such as on or a specific starting color/hue) and before it can proceed to the special effect state (such as dimming, color/hue change), sending another reset signal/pulse to the circuit. This has the effect of restarting the circuit from its initial state again. By repeatedly sending a reset pulse, the effect is either a continuous unchanged light output, or a series of short on pulses of light, with short off periods therebetween. The visual effect by a human viewer is that the light is on continuously due to the slow reaction time of the human eye and integration of the light over time. It is also possible to reset the special effects timer in the circuit, by disconnecting and reconnecting power to the entire circuit. This will have the effect of a reset since the circuit will reinitialize in a start state every time it receives power from a zero power state and initiate a timing sequence to restart from on state. The frequency of reset signals required will depend on the circuit construction, but for some devices a 50-60 Hz reset pulse rate has proven effective in creating the visual effect on an always on state while for other devices the required pulse rate may be several kilohertz, such as 50-60 kHz. In the preferred embodiment, using a bulb having a chip made by Zhejiang Newday Photoelectric Technology Co., Ltd.

Model YL11, Linhai, Taizhou City, China, the preferred pulse rate is 60 hz or at least 60 hz, but not more than 1 kHz. With other chips, the preferred range is at least as high as needed to prevent flicker being perceived by a human viewer, typically 60+ Hz and less than the maximum switching rate of the chip, in this case approximately 1 kHz. Above the switching rate, the reset to the initialization (start) state may not be reliable.

Voltage or current changes or both are sent in pulses to the bulbs, at a rate that is quick enough to reset the circuit/micro IC inside the twinkle LED that causes it to twinkle. By doing this it tricks the twinkle LED and IC into not turning on and off as the IC keeps resetting so that the LED appears that it is steady illuminating. The pulses happen so quickly that the human eye is not able to detect the bulb is flashing, similar to operation of an LED light set on 60 Hz without rectification where the human eye integrates the light and thinks it is steady on. In this disclosure, it could be as slow as 50-60 Hz, but will be fast enough to reset the micro IC in the twinkle LED to keep it from turning off long enough that the human eye will detect it and cause it to appear as in a steady-on state. During this pulsed voltage and or current sequence, if not fast enough it may appear that the lights are slightly dimmer than when steady on, but if fast enough will appear at the same brightness as when operating on normal power. Both states can be preferential depending on the lighting effect desired by the lighting designer.

To cause the set to twinkle (or other special effect), one would either have to slow down the pulses so that the IC only resets during the normal off period of the twinkle LED or provide a filtered or unfiltered DC or rectified AC power to the LEDs. This can be done with a range of voltages and power sources such as low voltage transformers or direct line voltage and frequency with or without frequency altering circuitry or periodic alternating the current or voltage.

This pulsing voltage or current can be performed a variety of ways including pulse with modulating circuit (PWM) or other methods to create a pulsed output quick enough to reset the circuit/IC in the twinkling or other special effect LED.

Bulbs can be wired in series or parallel, or in series parallel combinations and operated at line voltage or low voltage.

This embodiment uses the same amount of wire and LEDs as a regular set, only adding a low cost controller to the set, saving on the extra wires, larger bundles, heavier sets, higher cost, reduces the resources needed to manufacture such a set and makes it easier to decorate with than existing products, or the high cost of addressable circuitry on each bulb, a separate data wire, and a processor to send signals to control each bulb. So resetting of the chip trigger occurs when the chip associated with the illumination element is powered up. When the chip receives current, it will always start from a high brightness/color/hue etc. condition and then switch to lesser light output, in accordance with the predetermined special effect function, and then the brightness/hue/color rise/change again. By repeatedly applying power to the chip, the chip resets to its initialized state which is high illumination (or other special effects) so that the chip illuminates the element in its start or high illumination mode.

An alternative construction uses a chip which can decode a modulated signal to cause the reset. This is more complex, but if a modulated reset signal is sent to the chip on top of the power, the chip will reset but in this embodiment the chip could remain powered up at all times, instead of flashing, albeit rapidly. The illumination element will not pulse at all.

FIG. 1 illustrates an exemplary circuit 10 for which can be connected to light string (not shown) at connector J1. The light string can be a series or parallel wired bulbs (illumination elements+circuit components). It is only necessary that each bulb receives current to operate the illumination element and circuit.

Figure 7:
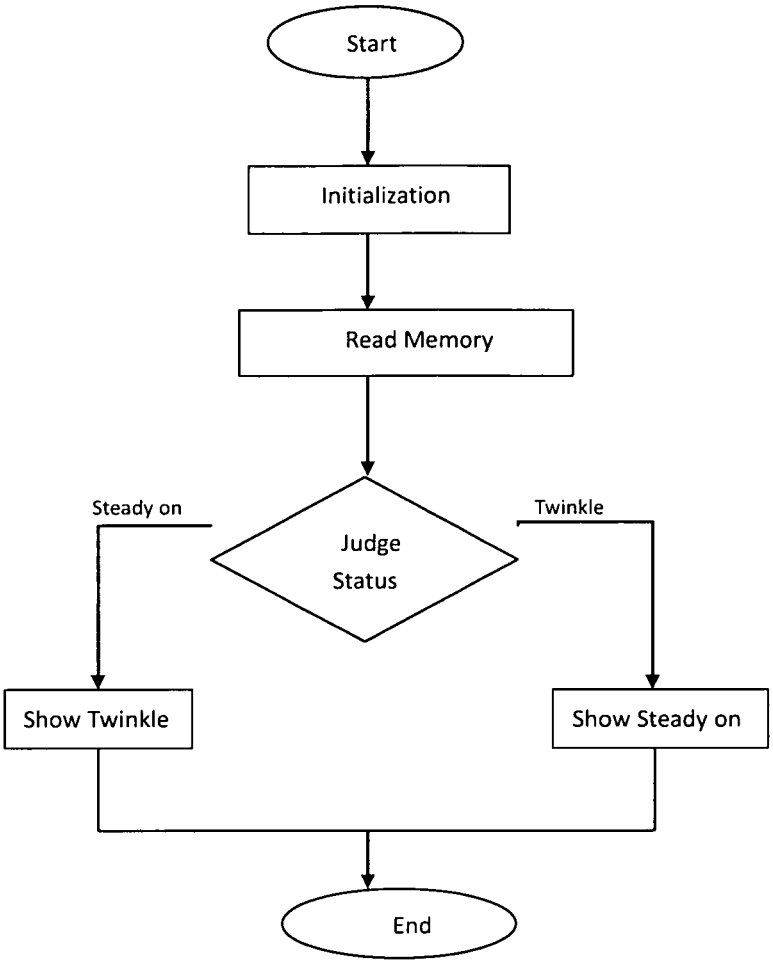
FIG. 7 is a flow chart of the MCU/MUC controller in FIG. 1 and FIG. 2.

The MUC/MCU microcontroller unit, IC chip 12 is of a type known in the art for supplying and controlling current to the light string at j1. The function of the chip is explained in the flow chart in FIG. 7. Output pin 7 is PWM output.

Figure 2:
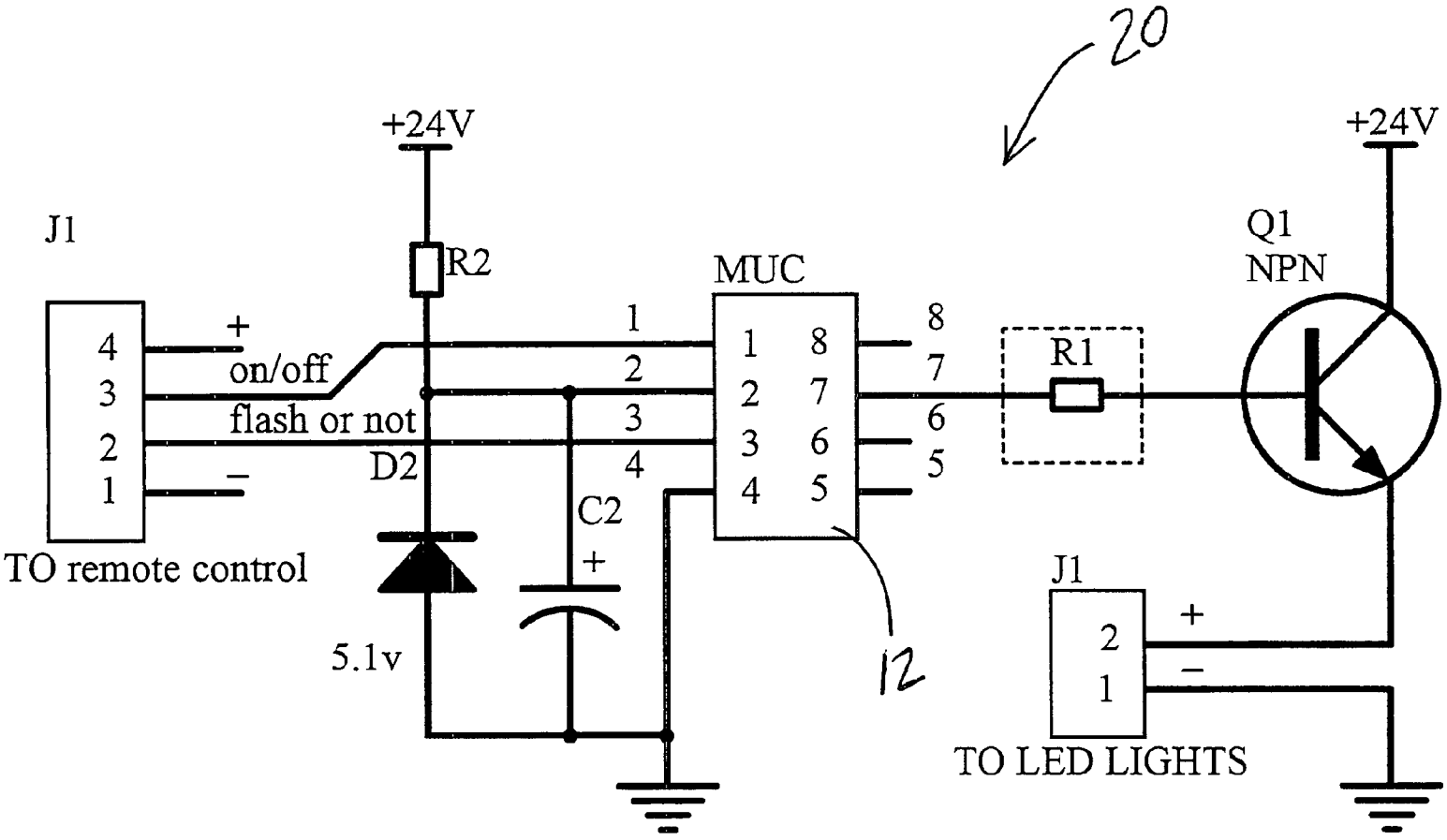
FIG. 2 shows an alternative circuit 20 which is differs from FIG. 1 in that it has an input for a wired or wireless remote control at connector.

FIG. 2 shows an alternative circuit 20 which differs from FIG. 1 in that it has an input for a wired or wireless remote control at connector J2 which will switch power on/off, and "flash" (i.e. special effects) on/off. The flash switch activates IC 12 to send rapid reset pulses to the bulb strings connected at J1 so that the special effects timers in the bulbs is rapidly reset thereby appearing to generate a contact on appearance by preventing the "twinkle" effect from occurring in the bulbs.

Figure 3:
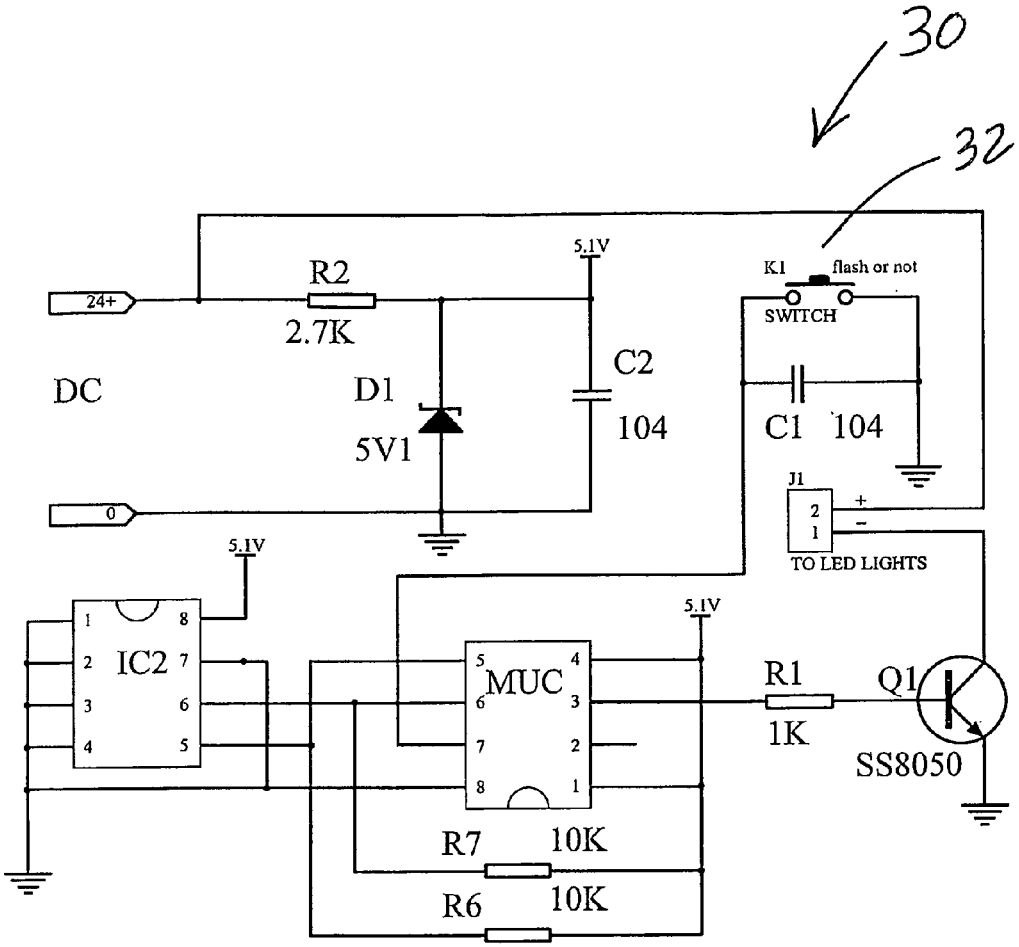
FIG. 3 shows a further variant 30 of the circuit in FIG. 2 with a switch 32 to control whether the reset pulses are sent or not.
Figure 8:
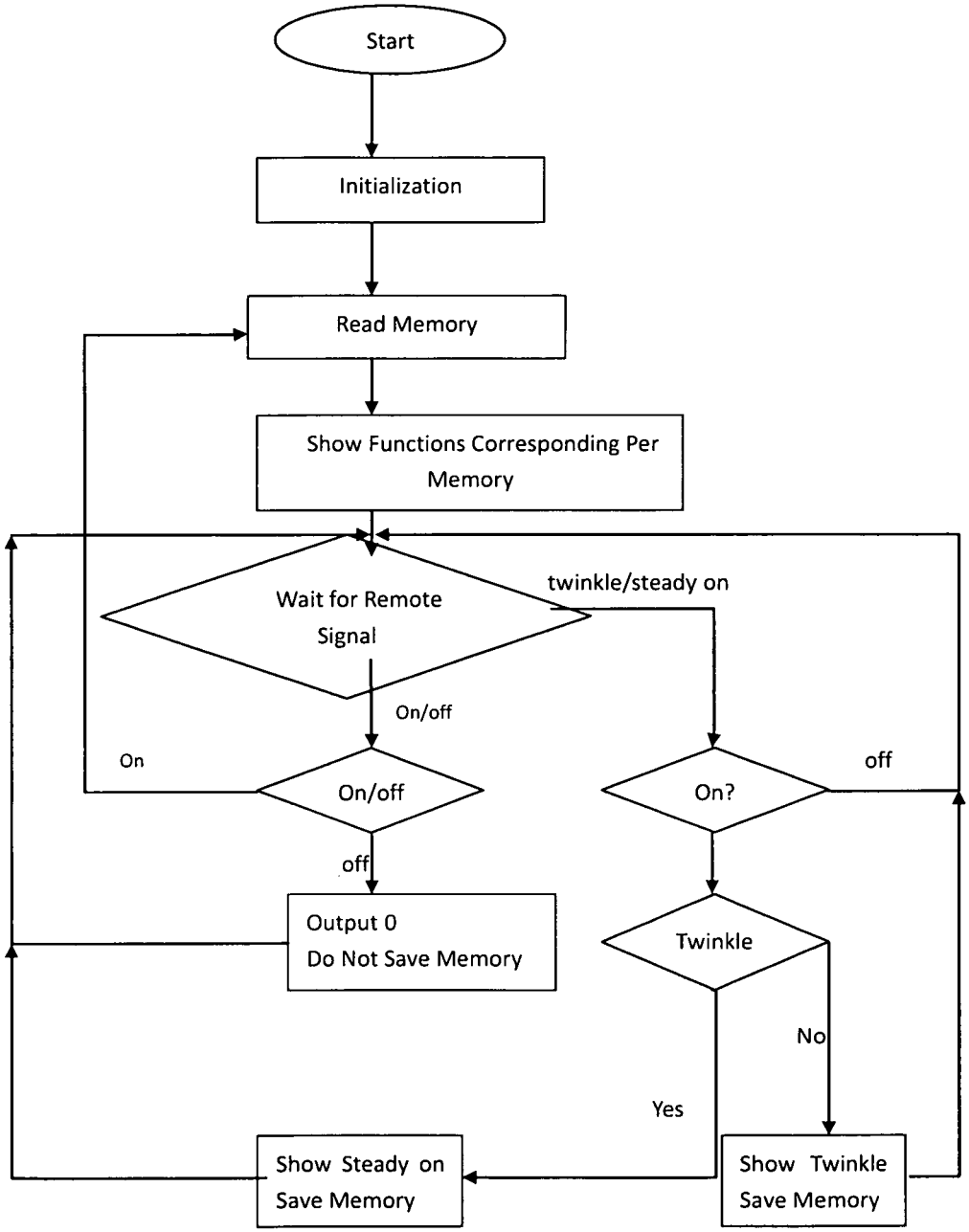
FIG. 8 is a flow chart of the MCU/MUC controller in FIG. 2 and FIG. 3.

FIG. 3 shows a further variant 30 of the circuit in FIG. 2 with a switch 32 to control whether the reset pulses are sent or not. FIG. 8 is a flow chart of the MCU/MUC controller in FIG. 3. Output pin 3 is the PWM output.

Figures 4A, 4B:
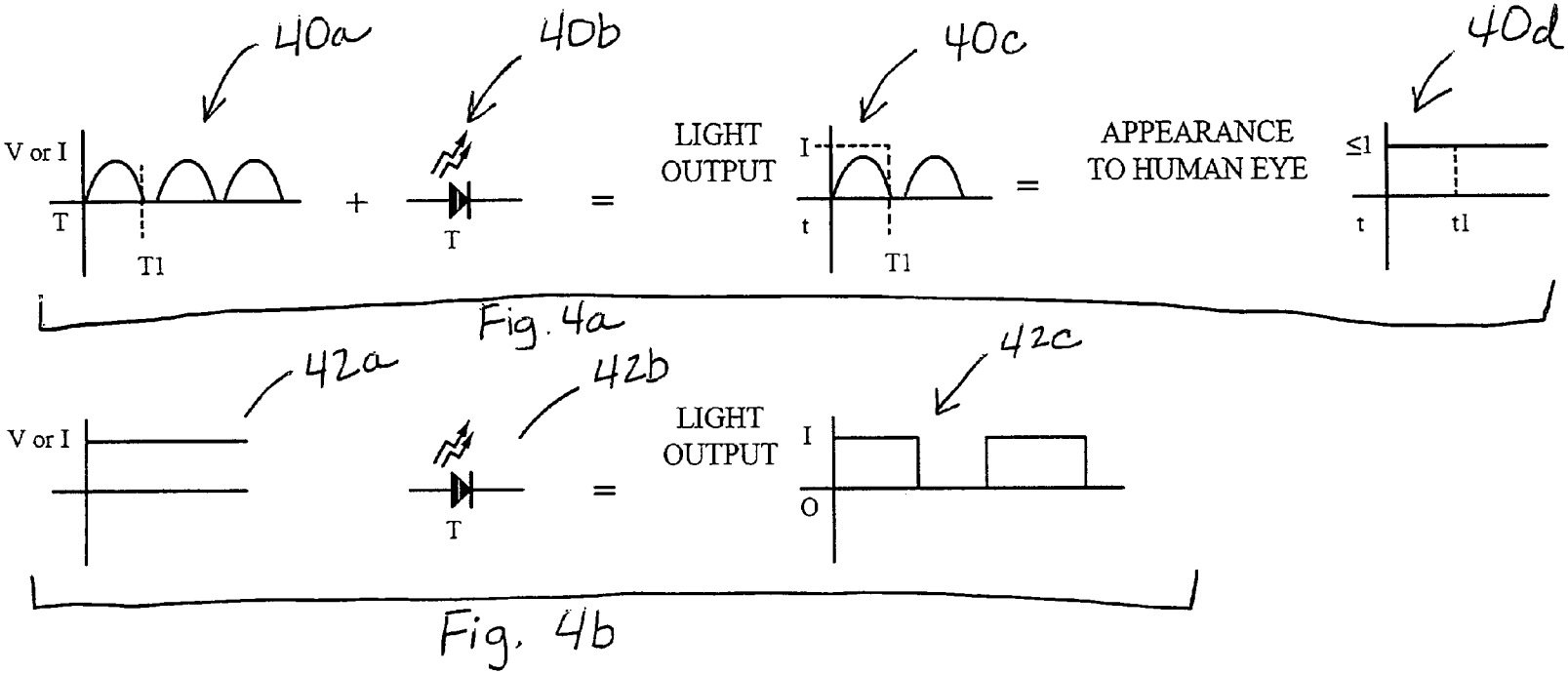
FIGS. 4*a* and 4*b* illustrate a group of sub figures which illustrate the visual effect.

FIGS. 4*a* and 4*b* illustrate a group of sub figures which illustrate the visual effect. Illustration 40*a* shows a varying voltage or current input to the bulb light string. A pure DC input is also possible. Illustration 40*b* is a schematic illustration on a bulb which in this case is an LED with a twinkle chip incorporated therein. This circuit/chip has been discussed previously as one commercially available and which provides a special effect on the illumination element when power is continuously applied to the chip. Twinkle, pulse, color, hue and other effects are available.

Illustration 40*c* is the actual light output at the illumination element when the special effect chip is reset at a rate fast enough to prevent the chip from executing its normal special effect. The light output mimics the power input, as if the chip was non-existent. The result, shown in illustration 40*d*, is that the human view perceives the light output as steady. This is from a chip which has no special provision for producing a steady light output, but the rapid resetting of the chip function has effectively "tricked" the chip and hence the viewer into seeing solid illumination when it should be providing some other special effect.

FIG. 4*b* show the "normal" result of the special effect chip in the light string when continuous current is applied at 42*a*. The bulb 42*b* produces some special effect, in this case pulsing or twinkling as shown in 42*c*.

Embodiment 2

Figures 5, 6:
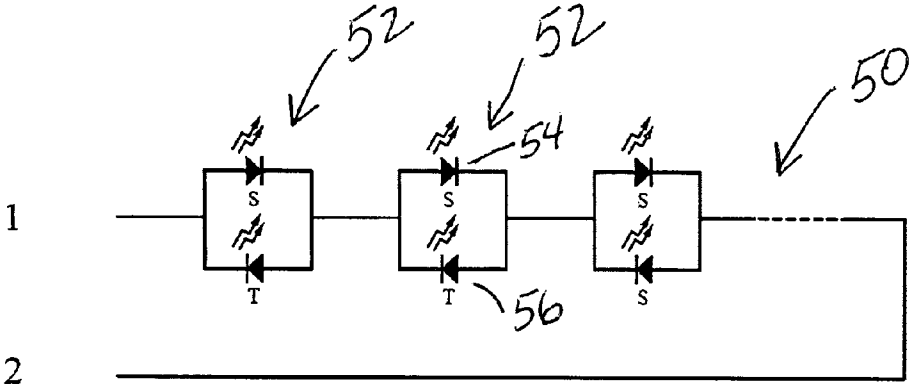
FIG. 5 illustrates the light string 50.
FIG. 6 illustrates the power conditions and results.

Embodiment 2 provides a similar result to the first embodiment but employs an entirely different solution. FIG. 5 illustrates the light string 50 and FIG. 6 illustrates the power conditions and results. In FIG. 5 a plurality of bulbs 52 (circuit elements and illumination elements combined) are shown in series, though parallel or a combination of series/parallel is equally possible. Bulbs 52 combine elements 54 "S", solid or always on LED with element 56 "t" a twinkle LED with twinkle (or other special function) circuit. Note that they are in parallel with reverse polarity. That means when power is applied in one direction, the 54 element will illuminate, but in with reverse power, the other element 56 will illuminate but with special function. FIG. 6 illustrates polarity and the result.

Thus, to make this circuit produce special effects, the polarity of the power need only be reversed. Of course, a mixture of T and S bulbs can be provided in the light string 50 to produce assorted outputs.

Alternatively, on inputs 1 and 2, a low frequency power source could be applied to provide a combination effect of the steady illuminating light source and the special effect light source at the same time. In other words, if AC is applied to inputs 1-2, the result will be the same as reversing polarity. The positive and negative wave forms will provide the reversing of polarity. In such case, the special effect is controlled by the frequency of the waveform.

Each bulb could be an LED and chip in the same housing, or in two separate housings next to each other to give the appearance when lit of one bulb, or combined in a refractive or translucent cover.

The bulb pairs can be wired in parallel or in series to other bulb pairs.

A simple controller or mechanical switching device is needed to be able to reverse the polarity of the bulb pairs so that one the polarity is in one direction, the set illuminates steady on, and when in the other direction, the set has a twinkle or other special effect function to it.

In first direction, all steady on bulbs are properly biased for current flow, while the twinkle bulbs are reversed biased.

In the other direction, all twinkle bulbs are properly biased for current flow. Depending on the application, if not all the bulbs were intended to twinkle, some of the twinkle bulbs could be substituted with steady on bulbs to create the effect desired.

This method uses the same amount of wire a regular set, adding a second set of LEDs and a low cost controller, saving on the extra wires, larger bundles, heavier sets, higher cost, reduces the resources needed to manufacture such a set and makes it easier to decorate with than existing products, or the high cost of addressable circuitry on each bulb, a separate data wire, and a processor to send signals to control each bulb.

For both embodiments the user selector of the operational mode (all steady on or all/partial twinkle/special effect) can be a variety of methods, including, but not limited to a selector switch, remote control, wireless control (WiFi, Bluetooth, ZigBee, etc.), app control, sound actuated, motion actuated, gesture actuated, etc.

The description of the invention and its applications as set forth herein is illustrative and is not intended to limit the scope of the invention. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A system for switchably changing the function of a special function bulb controller to switch an illumination element between having visual appearance of steady-on and a visual appearance of a predetermined special visual function, comprising:

a. an electrically powered illumination element;

b. a first switching circuit in communication said illumination element for controlling the flow of current to the element, said first circuit containing a controller for controlling the power to said illumination element to produce a predetermined special illumination visual lighting effect in the illumination element, said first circuit initiating said lighting effect when powered up starting from an initial steady-on illuminated state in the element and then proceeding to other special lighting effects occurring after the steady-on power up and periodically repeating said special lighting effect for a predetermined period of time, and c. a second switching circuit in communication with said first circuit, configured to periodically interrupt the flow of current to said first circuit, at an interruption frequency sufficient to cause the second circuit to reset to its steady on state without proceeding to said other special lighting effects, and thereby producing a plurality of steady-on illumination pulses in the illumination element.

2. The system of claim 1 wherein said interruption frequency is at least sufficient to create the visual appearance in the illumination element of a steady-on light.

3. The system of claim 2 wherein said interruption frequency is at least sufficient to provide a plurality of light pulses from the illumination element which appear to have substantially uniform intensity.

4. The system of claim 2 wherein said interruption frequency is at least more than the frequency of a human eye to observe flicker in the illumination element.

5. The system of claim 2 wherein said interruption frequency includes periodically energizing and reenergizing the second circuit to at least sufficiently to create the visual appearance in the illumination element of a steady-on illumination.

6. The system of claim 2 wherein said special visual function is a twinkle light effect.

7. The system of claim 2 wherein said special visual function is a blinking light effect.

8. The system of claim 2 wherein said special visual function is a color changing effect.

9. The system of claim 2 wherein said special visual function is a color hue changing effect.

10. The system of claim 2 wherein steady-on includes a momentary illumination at a substantially uniform light output.

11. A method of switchably changing the function of a special function bulb controller to switch an illumination element between having visual appearance of steady-on and a visual appearance of a predetermined special visual function, comprising the steps of:

a. electrically powering illumination element;

b. in communication with said illumination element, controlling the flow of current to the element to produce a predetermined special illumination visual lighting effect in the illumination element, controlling said element so that when it is powered up starting with an initial steady on illuminated state in the element and then proceed to said special lighting effects occurring after the steady-on power up and periodically repeating said special lighting effect for a predetermined period of time, and c. periodically interrupt the flow of current to said illumination element, at an interruption frequency sufficient to cause the steady-on state without proceeding to said special lighting effects, and thereby producing a plurality of steady-on illumination pulses in the illumination element.

* * * * *